US007512995B2

(12) United States Patent
Deffner

(10) Patent No.: US 7,512,995 B2
(45) Date of Patent: Apr. 7, 2009

(54) RIDING BREECHES

(76) Inventor: Karin Deffner, Am Burgfeld 6, 83714 Miesbach (DE)

( * ) Notice: Subject to any disclaimer, the term of this patent is extended or adjusted under 35 U.S.C. 154(b) by 0 days.

(21) Appl. No.: 11/245,823

(22) Filed: Oct. 7, 2005

(65) Prior Publication Data

US 2006/0143800 A1 Jul. 6, 2006

Related U.S. Application Data

(63) Continuation of application No. PCT/EP2004/002419, filed on Mar. 9, 2004.

(30) Foreign Application Priority Data

Apr. 10, 2003 (DE) ..... 103 16 523

(51) Int. Cl.
*A41D 1/06* (2006.01)

(52) U.S. Cl. ..... 2/227

(58) Field of Classification Search ..... 2/227, 2/228, 79, 214, 231, 400, 22, 46, 23, 238, 2/275, 67

See application file for complete search history.

(56) References Cited

U.S. PATENT DOCUMENTS

| | | | | | |
|---|---|---|---|---|---|
| 218,472 | A | * | 8/1879 | Banner | 2/231 |
| 250,131 | A | * | 11/1881 | Bortree | 2/231 |
| 317,334 | A | * | 5/1885 | Gaston | 2/231 |
| 337,316 | A | * | 3/1886 | Erlanger | 2/231 |
| 344,156 | A | * | 6/1886 | Boesenberg | 2/231 |
| 440,989 | A | * | 11/1890 | Appel | 2/231 |
| 538,767 | A | * | 5/1895 | Clauss | 66/177 |
| 541,334 | A | * | 6/1895 | Roschi | 2/227 |
| 557,563 | A | * | 4/1896 | Dunning | 2/401 |
| 967,023 | A | * | 8/1910 | Larkin | 2/227 |

(Continued)

FOREIGN PATENT DOCUMENTS

| | | |
|---|---|---|
| DE | 147071 | 4/1903 |

(Continued)

OTHER PUBLICATIONS

Lewin, W., 8.01 Physics I: Classical Mechanics, Fall 1999. (Massachusetts Institute of Technology: MIT OpenCourseWare). http://ocw.mit.edu (Accessed Aug. 8, 2008). License.

(Continued)

*Primary Examiner*—Alissa L Hoey
(74) *Attorney, Agent, or Firm*—Christopher Paradies; Fowler White Boggs P.A.

(57) ABSTRACT

A leg garment comprises two legs joined by a central seam. A piece material is disposed in the crotch area portion of the garment such that no central seam is present in the crotch portion. In one example, the inner thighs of the garment have an inserted material that is joined to the remainder of the garment and the piece of material in the crotch portion by seams. Extra material projecting from the seams may be adhered to adjacent material by an adhesive such that the projecting material by an adhesive such that the projecting material extends away from the crotch portion. The inserted material and the piece of material at the crotch portion may be made of leather or a leather-like material that is capable of protecting a rider from saddle sores.

12 Claims, 2 Drawing Sheets

U.S. PATENT DOCUMENTS

| | | | | | |
|---|---|---|---|---|---|
| 1,277,074 | A | * | 8/1918 | Heitzeman | 2/78.3 |
| 1,277,700 | A | * | 9/1918 | Decker et al. | 2/401 |
| 1,633,610 | A | * | 6/1927 | Schneider | 2/407 |
| 1,831,930 | A | * | 11/1931 | Speh | 2/227 |
| 1,863,482 | A | * | 6/1932 | Isaacs | 2/228 |
| 2,093,371 | A | * | 9/1937 | Sheehy | 2/407 |
| 2,119,602 | A | * | 6/1938 | Roberts et al. | 2/227 |
| 2,146,494 | A | * | 2/1939 | Adamson | 2/228 |
| 2,318,199 | A | * | 5/1943 | Clements | 2/407 |
| 2,476,112 | A | * | 7/1949 | Pinchoff | 2/231 |
| 2,570,497 | A | * | 10/1951 | Senderowitz | 2/401 |
| 2,651,047 | A | * | 9/1953 | Emerson | 2/407 |
| 3,392,733 | A | * | 7/1968 | Blair | 450/104 |
| 3,526,229 | A | * | 9/1970 | Blair | 450/118 |
| 3,793,646 | A | * | 2/1974 | Tempelhof | 2/227 |
| 4,000,630 | A | * | 1/1977 | Imboden | 66/177 |
| 4,004,297 | A | * | 1/1977 | Polack | 2/227 |
| 4,215,685 | A | * | 8/1980 | Ibel | 602/67 |
| 4,261,060 | A | | 4/1981 | Zawacki | |
| 4,301,546 | A | * | 11/1981 | de Polo | 2/227 |
| D267,674 | S | * | 1/1983 | Livernois | D2/747 |
| 4,371,989 | A | | 2/1983 | Polsky | |
| 4,488,317 | A | * | 12/1984 | Polsky | 2/227 |
| 4,613,991 | A | * | 9/1986 | Grover | 2/23 |
| 4,670,913 | A | * | 6/1987 | Morell et al. | 2/227 |
| 4,805,243 | A | * | 2/1989 | Gibbens et al. | 2/228 |
| 4,843,654 | A | * | 7/1989 | March | 2/227 |
| 4,999,854 | A | * | 3/1991 | Fell | 2/409 |
| 5,033,123 | A | * | 7/1991 | Audet | 2/227 |
| 5,081,716 | A | * | 1/1992 | Lehenbauer et al. | 2/77 |
| 5,159,721 | A | * | 11/1992 | Senser et al. | 2/227 |
| 5,210,877 | A | * | 5/1993 | Newman | 2/456 |
| D360,516 | S | * | 7/1995 | Persinger | D2/738 |
| 5,678,250 | A | * | 10/1997 | Nolan | 2/227 |
| 5,930,838 | A | * | 8/1999 | Carter-Scott-Pomije | 2/79 |
| 6,041,442 | A | * | 3/2000 | Owen | 2/228 |
| 6,401,250 | B1 | * | 6/2002 | McNabb | 2/78.2 |
| D483,551 | S | * | 12/2003 | Kallen | D2/742 |
| 6,810,534 | B2 | * | 11/2004 | Durkin et al. | 2/267 |
| 6,918,140 | B1 | * | 7/2005 | Cooper | 2/228 |
| 6,990,693 | B2 | * | 1/2006 | Reschewitz | 2/228 |
| D522,718 | S | * | 6/2006 | Rieder | D2/742 |
| D532,958 | S | * | 12/2006 | Kent | D2/742 |
| D546,029 | S | * | 7/2007 | Rindle | D2/738 |
| 2004/0143890 | A1 | | 7/2004 | Reschewitz | |
| 2005/0066408 | A1 | * | 3/2005 | Varela | 2/69 |

FOREIGN PATENT DOCUMENTS

| | | |
|---|---|---|
| DE | 194602 | 10/1906 |
| FR | 2 446 075 | 8/1980 |

OTHER PUBLICATIONS

Creative Commons Attribution-Noncommercial-Share Alike.

* cited by examiner

RIDING BREECHES

RELATED APPLICATIONS

The present application is a continuation of PCT Patent Application Serial No. PCT/EP2004/002419, filed Mar. 9, 2004 claiming priority of the German Patent Application Serial No. 103 16 523.1, filed Apr. 10, 2003, incorporated herein by reference in their entirety.

FIELD OF THE INVENTION

The present invention relates to trousers comprising a central seam, suitable for use as riding breeches.

BACKGROUND OF THE INVENTION

Commercially available riding breeches have a central seam which results in uncomfortable pressure and abrasion injuries, especially in the sensitive crotch area which supports a large portion of the body weight during riding. Many riding breeches comprise an insert of leather or leather-like materials in the area of the seat and the inside of the legs. The purpose of this insert is to reinforce the area of the riding breeches which is in contact with the saddle during riding and thus is exposed to stronger loading. The skin is protected by the leather from saddle sores, and the leather insert reduces any slipping to and from in the saddle. However, leather and leather-like materials result in an especially thick central seam which is capable of causing uncomfortable pressure and abrasion injuries in the sensitive crotch area of the rider.

SUMMARY OF THE INVENTION

According to an exemplary embodiment of the present invention, trousers have a central seam and an additional piece of material is inserted in the crotch area such that no central seam is present in crotch portion of the trousers, overcoming the previously described disadvantages of commercially available riding breeches having a central seam in the crotch area.

The crotch area may be particularly understood within the context of the present invention as the area of the human being (male or female) which extends from the anus via the pubic bone up as far as the upper edge of the pubic hair. More preferably, one example limits the area protected to an area within the area defined as the crotch area. The crotch area may be defined laterally according to an exemplary embodiment of the present invention by the transition to the inside of the femor. Functionally, the portion of the crotch to be protected is defined as the portion of the rider that is sensitive to discomfort from pressure and abrasion of a seam. Within the context of the present invention the crotch area can extend onto the inside of the femoral. Preferably, in adult trousers, the width of the crotch area is about 20 cm or less for an average-sized rider (women and men). An artisan would provide a greater width than 20 cm for larger sizes. The additional piece of material may cover only certain, selected especially sensitive portions within and around the crotch area to prevent uncomfortable irritation or pain from seams.

DETAILED DESCRIPTION OF EXEMPLARY EMBODIMENTS

The drawings and detailed description provide specific examples of the invention, but the invention should not be limited merely to the examples disclosed. Instead, the invention should be limited only by the claims that may eventually issue. The examples are not intended to limit the scope of any claims that issue. The scope of the claims should be limited only by the language of the claims themselves.

Figure 1:
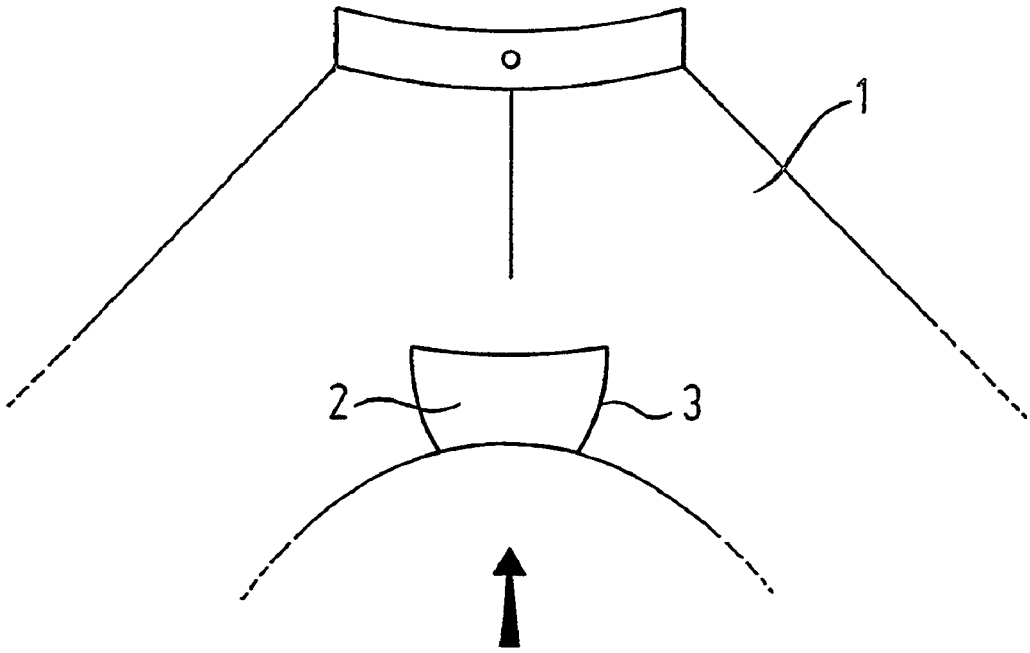
FIG. 1 is a schematic front view of a portion of trousers 1 according to an exemplary embodiment of the present invention viewed obliquely from below.
Figure 2:
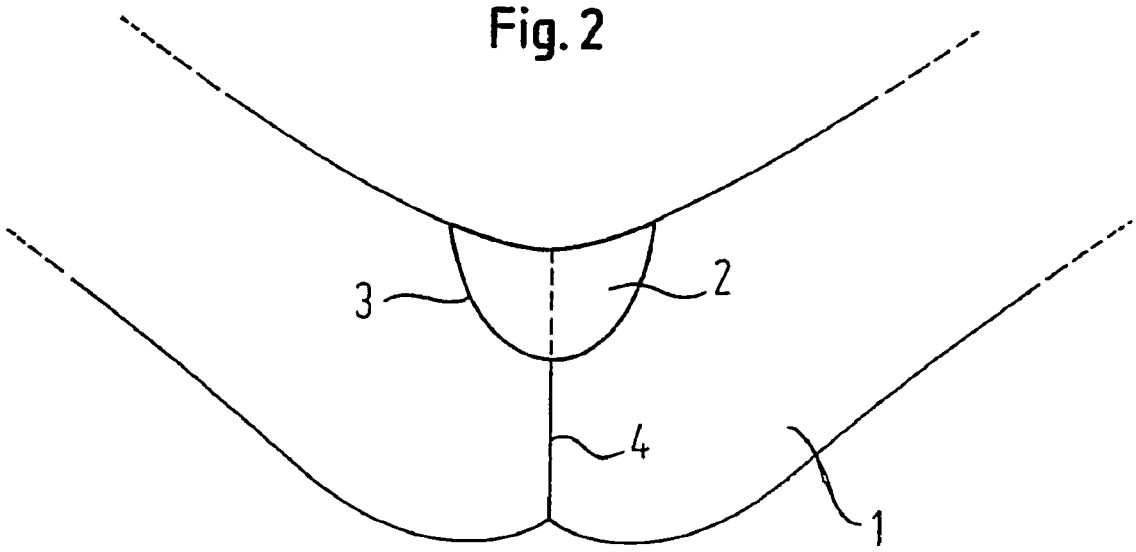
FIG. 2 is a schematic bottom view along the arrow drawn in FIG. 1 of the example shown in FIG. 1.

A trouser 1 is shown in FIG. 1 having a piece of material 2 inserted at the crotch portion of the trousers. The piece of material 2 may be located in the crotch area and may be joined by a seam 3 to the remaining material of the breeches 1. The term breeches and trousers are used interchangeably with "leg garment" and have the same meaning. The specially inserted piece of material 2 may have the shape of an ellipse, a circle, an emblem, a label, a semi-ellipse, an upwardly extended semi-circle or other patters and shapes. FIG. 2 shows a view of the leg garment illustrated in FIG. 1 according to a view from below. The central seam 4 is shown in relation to the piece 2. The dashed line shows the continuation of the central seam such as is present in conventional riding breeches.

Figure 3:
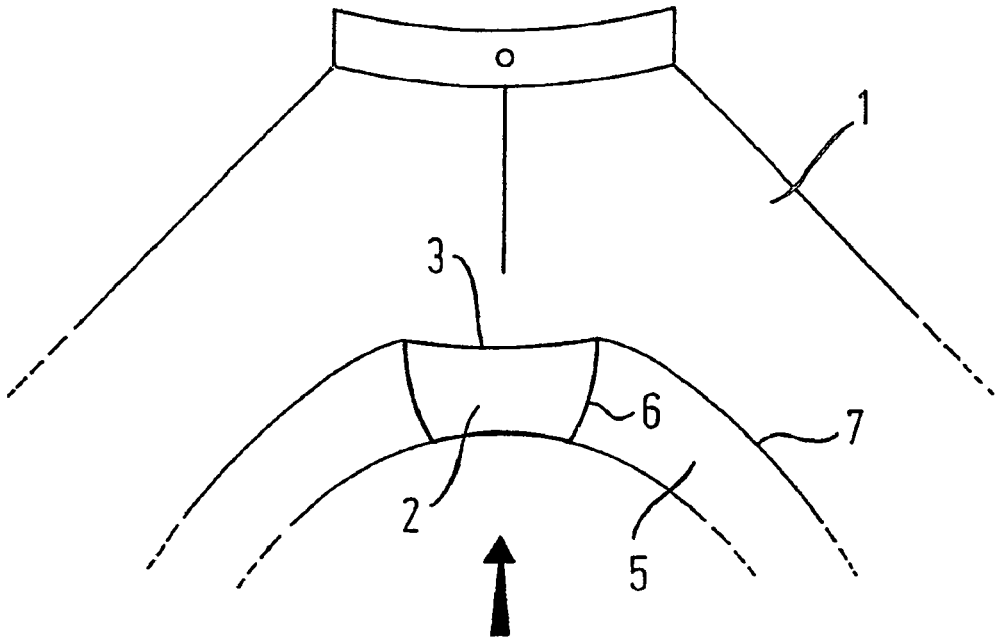
FIG. 3 is a schematic front view of a portion of a trouser viewed obliquely from below.
Figure 4:
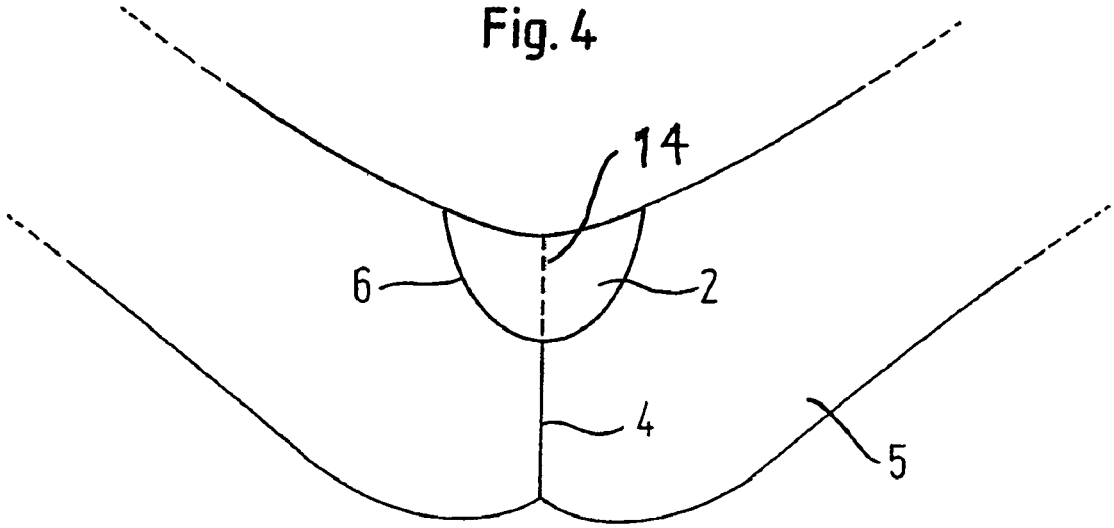
FIG. 4 is a schematic view along the arrow drawn in FIG. 3.

Another embodiment of the invention is shown schematically in FIG. 3. The areas of the leg garment 1 which cover the insides of the legs and the seat area are formed by insert 5 which may either consist of the material from which the rest of the breeches 1 is made or of other material, such as leather or a leather-like material. The insert 5 may be made of the same material commercially available in riding breeches, for example, reinforcing the parts of the riding breeches subject to severe strain during riding. A piece of material 2 is inserted such that no central seam rubs against the crotch portion of the rider. The insert 5 is joined to the remaining part of the breeches via a seam 7, and the piece of material 2 may be joined to the insert 5 via the seam 6 and to the remainder of the breeches 1 by the seam 3. FIG. 4 shows the central seam 4 where a dashed line 14 shows an extension of the central seam, which would be present in commercially available riding breeches. In one example, crotch seam 3 and reinforcing seam 7 meet at transition seam 6 forming a continuous line with the rest of the material of the breeches 1.

In the examples shown in the drawings, the insert 2 is joined to the remaining part of the leg garment or to the insert 5 by the seam 3,6. The seam 3, 6 may cause a discontinuity in one or both of the inside and outside surfaces of the material of the breeches 1. The discontinuity may be accompanied by the projecting of material from the seam 3,6. The projecting material on the inside of the leg garment which is formed by the seam 3, 6 may be glued or adhered to the adjacent material. The excess length of the insert preferably points outwards away from the crotch portion. Commercially available adhesives which are suitable for skin contact and are moisture-resistant are used for the adhesion of the projecting material 1.

The leg garment 1 may be made of one type of material. Preferably, riding breeches 1 are made of at least two materials. The material may be selected from commercially available, robust, resistant materials, leather or leather-like polymeric materials. The material for the inserts 2, 5 is preferably selected from leather or leather-like polymeric materials that provide for wear-resistance and protect the riders skin from saddle sores. The material for the remainder of the leg garment is preferably selected from commercially available robust, resilient and resistant materials. For example, the remaining material of riding breeches 1 may be of a stretchable fabric, which fits snuggly on the riders legs.

The present invention makes it possible to overcome the disadvantages of commercial riding breeches, Already existing and proven patterns and shapes may be retained using the insert 2 such that the problem caused by the central seam are no longer a problem in the crotch area. As a result of the preferred joining of the inserted piece to the remainder of the breeches by a single seam and adhering the projecting material on the inside of the leg garment away from the crotch portion, further bulges which can result in uncomfortable pressure and abrasion injuries may be avoided. In this example, the material 2 replaces a portion of the insert of commercial riding breeches 1 and eliminates the extension of the seam 14, which otherwise is located in the crotch portion of the breeches 1.

It should be noted that the term "comprising" does not exclude other elements or steps and the "a" or "an" does not exclude a plurality. Also elements described in association with different embodiments may be combined.

It should also be noted that reference signs in the claims shall not be construed as limiting the scope of the claims.

What is claimed:

1. A leg garment comprising:

a central seam joining a material of two leg portions;

a crotch portion comprised of a piece of material inserted in the crotch portion such that the central seam does not extend into the crotch portion; and an inserted material, different than the material of the two leg portions, joined to each of the two leg portions such that the inserted material covers a inside portion of each leg at least as far as just below a knee and a seat portion of the leg garment, wherein the inserted material and the piece of material are joined at a peripheral crotch seam wherein a first type of material is selected for the two leg portions, the first type of material being different than a second type of material selected for the inserted material or the piece of material, and the second type of material is selected such that, when a person is mounted in a saddle, slipping between the leg garment and the saddle is reduced compared to using the first type of material for each of the two leg portions, the inserted material and the piece of material.

2. The leg garment according to claim 1, wherein the two leg portions are made of a different material than the piece of material and the inserted material.

3. The leg garment according to claim 1, wherein the inserted material is made of leather or a leather-like material.

4. The leg garment according to claim 1, wherein the inserted material is joined to each of the two leg portions by an insert seam.

5. The leg garment according to claim 4, wherein the piece of material has a projecting portion projecting from the crotch seam and the projecting portion is adhered to adjacent material on the inside of the breeches.

6. The leg garment according to claim 4, wherein the projecting portion of the piece of material points outwards away from the crotch portion.

7. A leg garment for a person comprising:

two leg portions made of a first material joined together along a central seam, each of the two leg portions having a front longitudinal side and a back longitudinal side;

a seamless crotch portion; and two seamless inserts each made of a second material, different from the first material, and each joining at least a portion of the front longitudinal side and the back longitudinal side of a respective one of the two leg portions such that the two seamless inserts cover the inside portion of each leg and extend at least to just below a knee of the person;

wherein the seamless crotch portion is made of a third material disposed in a sensitive area of a crotch of the person such that the central seam does not extend into the sensitive area and a peripheral crotch seam is formed peripherally to the sensitive area of the crotch of the person and the peripheral crotch seam joins the seamless crotch portion to the two inserts and the two leg portions, wherein the first material is of a first type, and the second material or the third material is selected of a second type such that, when the person is mounted in a saddle, slipping between the leg garment and the saddle is reduced compared to selecting the second material and the third material of the same type as the first material.

8. The leg garment according to claim 7, wherein the first material of the two leg portions are made of a different material than the third material of the crotch portion and the second material of the inserts.

9. The leg garment according to claim 7, wherein the second material is made of leather or a leather-like material.

10. The leg garment according to claim 7, wherein the second material is joined to the two leg portions by an insert seam.

11. The leg garment according to claim 10, wherein the third material of the crotch portion has a projecting portion projecting from the peripheral crotch seam and the projecting portion is adhered to adjacent material on the inside of the breeches.

12. The leg garment according to claim 11, wherein the projecting portion of the third material points outwards away from the sensitive area.

* * * * *